United States Patent [19]

Garner et al.

[11] 4,359,112

[45] Nov. 16, 1982

[54] HYBRID DIAMOND INSERT PLATFORM LOCATOR AND RETENTION METHOD

[75] Inventors: Lloyd L. Garner, Dana Point; Joe W. Vincent, San Juan Capistrano; William Baker, III, Irvine, all of Calif.

[73] Assignee: Smith International, Inc., Newport Beach, Calif.

[21] Appl. No.: 161,199

[22] Filed: Jun. 19, 1980

[51] Int. Cl.[3] ..... E21B 9/36

[52] U.S. Cl. ..... 175/329; 175/336; 175/410

[58] Field of Search ..... 175/329, 330, 410, 411, 175/413, 374, 375, 336; 228/193; 51/307, 309, 297

[56] References Cited

U.S. PATENT DOCUMENTS 4,244,432 1/1981 Rowley ..... 175/329

*Primary Examiner*—William F. Pate, III

*Attorney, Agent, or Firm*—Robert G. Upton

[57] ABSTRACT

This concept discloses a new technique which uses brazing or diffusion bonding methods to attach a diamond disk to a wedge-shaped steel support platform on a hybrid type of bit. The invention is primarily concerned with the attachment of the innermost diamond cutting disk on the wedge-shaped drag bit face portion of the hybrid bit. It is particularly difficult to secure any kind of cutting structure to the innermost portion of a rock bit because of the lack of material available to secure the cutting structure to the drag bit face. Space limitations on the drag bit face prevent the use of conventional interference fit diamond insert studs for the innermost cutters.

1 Claim, 4 Drawing Figures

HYBRID DIAMOND INSERT PLATFORM LOCATOR AND RETENTION METHOD

CROSS-REFERENCE TO RELATED APPLICATION

This application relates to a commonly assigned application entitled HYBRID ROCK BIT, filed Apr. 28, 1980, Ser. No. 144,515.

BACKGROUND OF THE INVENTION

1. Field of the Invention

This invention relates to hybrid type rock bits.

More particularly, this invention relates to a multi-cone rock bit with drag bit type diamond cutters positioned in the face of a drag bit portion of the bit and the means in which the innermost diamond disks are attached to the face of the drag bit portion.

2. Description of the Prior Art

Hybrid bits of the type that combine multi-cone cutters with drag bit cutters are known in the art.

U.S. Pat. No. 4,006,788, assigned to the same assignee as the present invention, describes a rock bit for recovering core samples as well as rock bit variations for drilling oil wells or the like. In each of the several embodiments described, diamond cutters are strategically mounted on a bit body for cutting rock by a shearing action. Each of the diamond cutters is in the form of a thin diamond disk bonded to a tungsten carbide stud that is inserted into the bit body. The diamond inserts are generally mounted in the drag bit portion of the hybrid bits. The inserts are typically mounted by interference fitting the body of the diamond insert into the face of the drag bit portion. The face of the drag bit portion is drilled, followed by insertion of the diamond insert body into the drilled hole.

This patent is disadvantaged in that the innermost diamond cutting insert blanks nearest the center of the borehole cannot be interference mounted in the face of the drag bit portion. The inserts cannot be mounted close enough to the center of the hole to remove the core of the borehole. This is true because of the necessity of shaping the drag bit portion into a wedge or pie-shaped configuration. The tip of the drag bit face portion nearest the center of the bit provides the least area to mount the diamond insert into the body of the drag bit portion.

The present invention describes a means in which the innermost diamond cutting disk may be mounted to the tip of the pie-shaped drag bit face, thus providing a means to remove the core portion in the area of the center of the borehole bottom. The central area of the borehole bottom is one of the most difficult areas from which to remove material.

SUMMARY OF THE INVENTION

It is an object of this invention to provide a means to mount the innermost diamond cutter disk to a drag bit portion of a hybrid bit.

A hybrid rock bit is disclosed wherein the rock bit body has a pin end at a first end and one or more legs with cutter cones mounted on journals extending from the legs at a second cutter end of the bit body. One or more drag bit legs are also attached to the body at the second cutter end and coextend with the cutter cone legs. The drag bit legs have a plurality of diamond inserts positioned in a face of the drag bit legs. The face formed by the drag bit legs is substantially wedge-shaped, a tip of the wedge-shaped face being positioned nearest the center of the second cutting end of the hybrid rock bit. Means are provided for mounting one or more diamond disks to the innermost portion of the wedge-shaped face nearest the center of the second cutting end of the hybrid rock bit. The central diamond disks serve to remove the core material from the center of a borehole bottom.

An advantage over the prior art is the ability to mount a diamond disk to the innermost tip of a wedge-shaped drag bit portion of a hybrid rock bit by diffusion bonding or braxing the diamond disk to the tip of the wedge.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
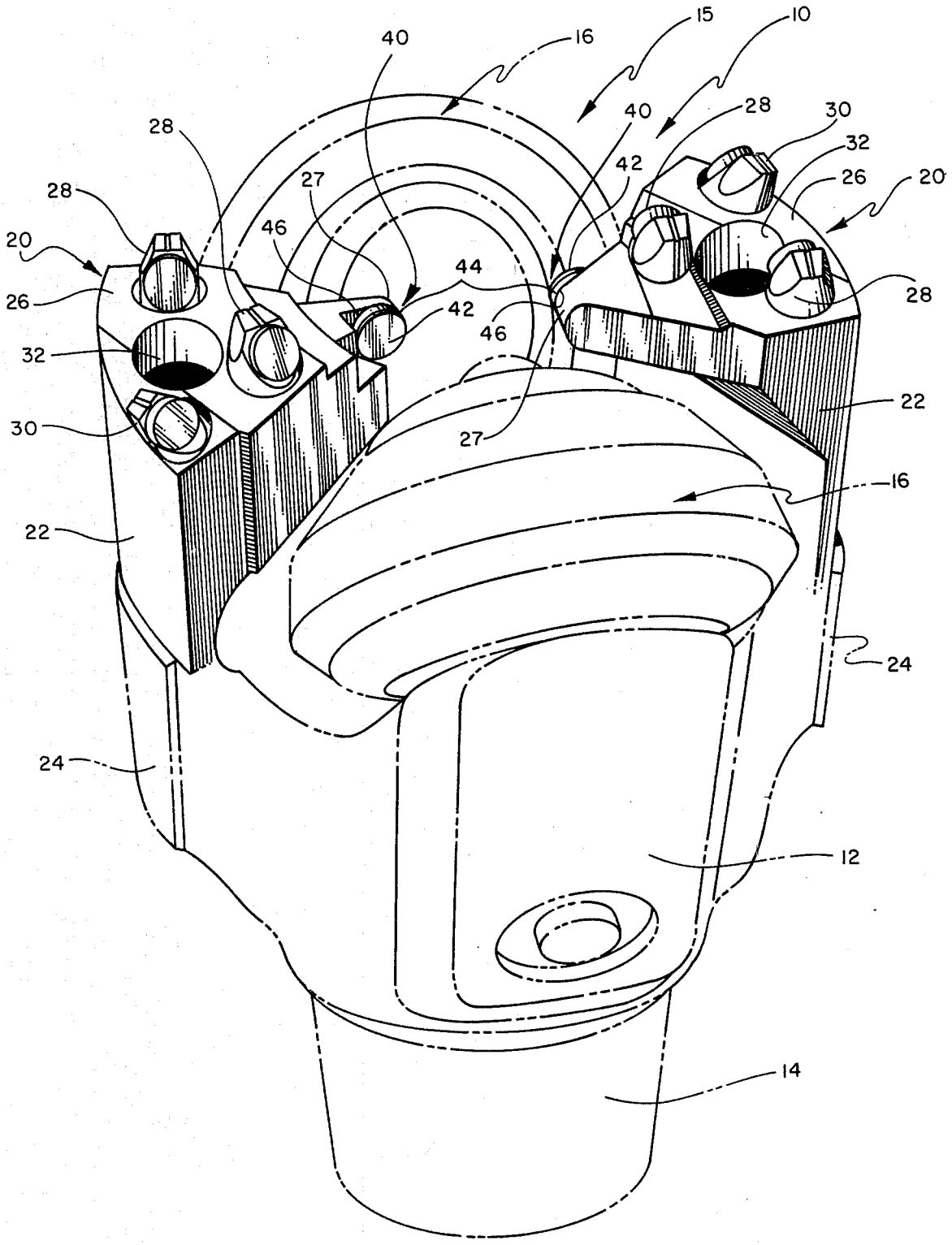
FIG. 1 is a perspective view of a hybrid rock bit illustrating a pair of cones with an adjacent pair of drag bit legs on either side of the cones.

The perspective view of FIG. 1 illustrates a hybrid bit, generally designated as 10, consisting of a bit body 12 with a pin end 14 and a cutting end 15. At the cutting end a pair of opposed roller cones 16 are positioned adjacent a pair of drag bit segments, generally designated as 20. Each wedge-shaped or pie-shaped drag bit segment 20 is comprised of a leg 22 which extends from a stabilizer segment 24 and ends in a face portion 26. The innermost portion or end 27 of wedge drag bit 20 terminates just short of the centerline of the bit. Each drag bit segment defines at least one hydraulic passage or nozzle 32. In addition, each drag bit portion has inserted therein a multiplicity of diamond inserts 28. Usually one or more gage row inserts 30 are utilized to maintain the gage of a borehole. Each of these diamond inserts are interference fitted within holes drilled in face 26 of drag bit segment 20. However, at tip 27 of the pie-shaped segment there is not enough material to mount a diamond insert to remove the material from the center of the borehole.

Special diamond disks without a tungsten carbide stud body, generally designated as 40, are metallurgically bonded to tip 27 of wedge 20. The diamond disks 40 as well as the diamond insert stud blanks 28 and 30, for example, are fabricated from a tungsten carbide substrate with a diamond layer 42 sintered to a face of a substrate, the diamond layer being composed of a polycrystalline material. The synthetic polycrystalline diamond layer is manufactured by the Specialty Material Department of General Electric Company of Worthington, Ohio. The foregoing drill cutter blank is known by the trademark name of Stratapax drill blank. The reduced substrate 44 (when compared to the stud body of inserts 28 and 30) of the disk 40 is mounted directly to end 27 of wedge-shaped drag bit segment 20. The diamond cutting face 42 of disk 40 would be essentially the same as the diamond cutting surface of the diamond inserts 28 and 30.

Figure 2:
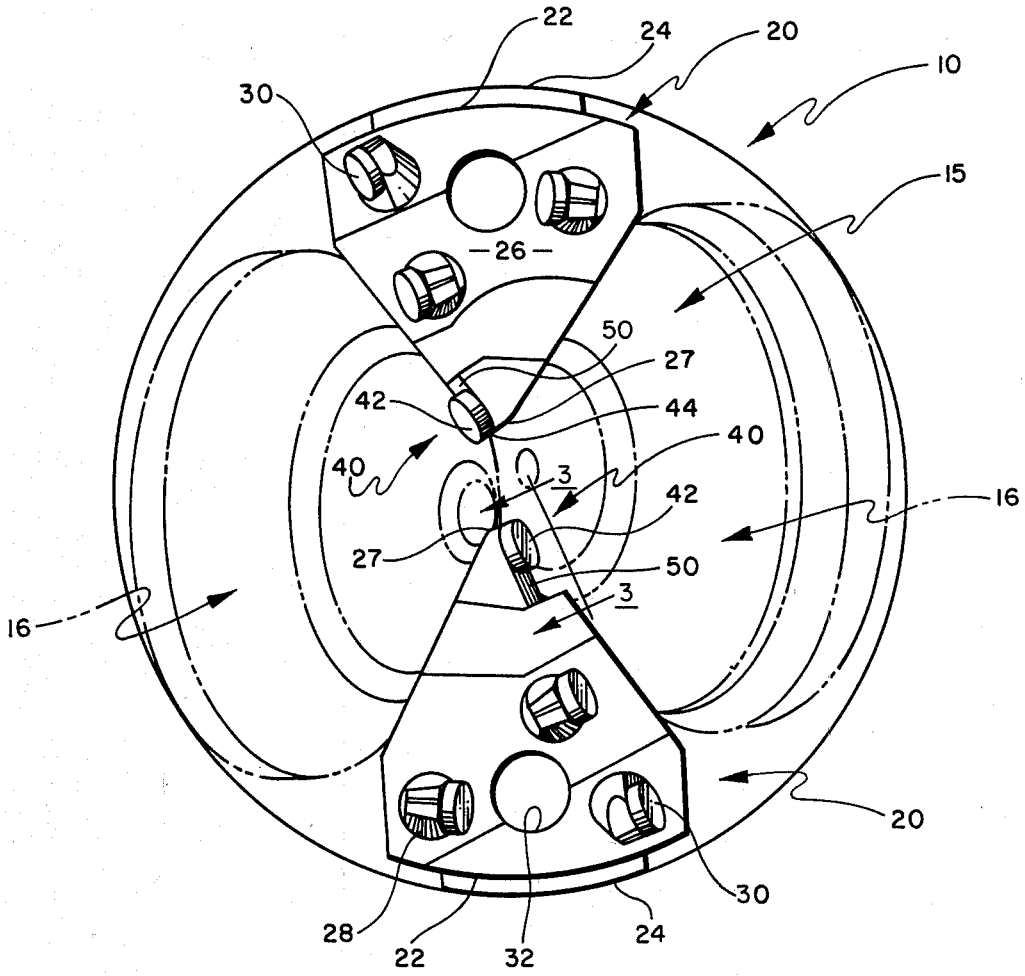
FIG. 2 is a view looking up at the bottom of the hybrid rock bit illustrating the wedge-shaped drag bit segments and where they are positioned relative to the rotating cones.
Figure 3:
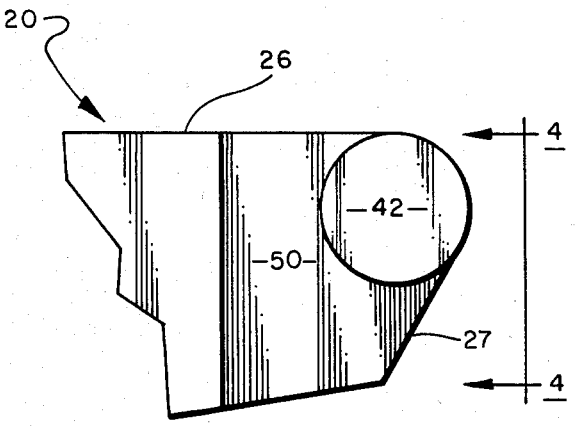
FIG. 3 is a view taken through 3—3 of FIG. 2 illustrating the placement of the diamond disks on the tip of one of the drag bit legs.
Figure 4:
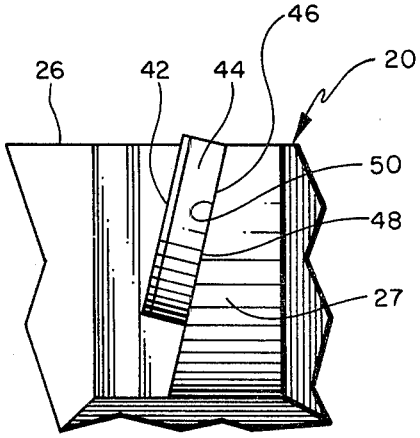
FIG. 4 is a view taken through 4—4 of FIG. 3 illustrating further the positioning of the diamond disks relative to the tip of the wedge-shaped drag leg of the hybrid bit.

With reference now to FIG. 2, the end view clearly illustrates the relationship of the wedge-shaped drag bit segments 20 relative to the opposed roller cones 16. This view clearly illustrates the problem with mounting standard diamond stud body insert blanks into, for example, forged high-grade steel drag bit segments to cut the core or center of a borehole. The diamond disks 40 are, for example, diffusion bonded or brazed onto the tip 27 of the steel drag bit segments 20.

Wherein the drag bit legs 22 are fabricated from high-grade steel, such as A.I.S.I. 9315 (American Iron and Steel Institute standard), diffusion bonding of the diamond disks 40 to tip 27 is preferred. The nickel content of 9315 is from 2.9 to 3.5 percent. The high content of nickel in the steel makes the diffusion bonding process ideal. It is well known in the metallurgical art that the diffusion bonding process results in a true metallurgical bond. The following steps in the diffusion bonding process include milling of the diamond disk platform 50 (FIGS. 2, 3 and 4) at end 27 of drag bit segment 20. The tungsten carbide substrate 44 bonding surface 48 and the platform 50 of end 27 is subsequently cleaned. The disk 40 is then tacked or otherwise temporarily attached to platform 50 by any number of well known techniques including copper foil wrap, ultrasonic welding, electron beam welded tack or a laser beam tackweld; the idea being to secure the disk to the platform during the diffusion bond cycle. The drag bit leg with attached disk 40 is then placed in a cannister substantially full of graphite and sealed. The cannister is subsequently placed in an autoclave furnace capable of isostatically pressing the "canned" assembly at pressures from 15,000 to 30,000 pounds per square inch. The assembly is heated in the autoclave to a temperature of about 1200° F. for from four to eight hours. The drag bit leg 20 is then removed from the furnace, uncanned and cleaned to complete the diffusion bonding process.

An alternative brazing process includes milling of platform 50 in end 27, preparing both the surface 50 in end 27 and substrate backing 48 of disk 40 with acid and flux. The adjacent surfaces 50 and 48 are subsequently "tinned" or electroplated in a plating bath, followed by brazing in a furnace, induction brazing or hand torch.

With reference to FIGS. 1 and 2, the legs 20 are then joined to the journal bearing legs supporting the cones 16 in a conventional manner.

Obviously, the teachings of the present invention could be used on different rock bit hybrid configurations. For example, there could be a single 120° pie-shaped drag bit leg segment adjacent a pair of 120° roller cone leg segments without departing from the scope of this invention.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

We claim:

1. A hybrid rock bit comprising:

a rock bit body having a pin end at a first end and one or more legs with cutter cones mounted on journals extending from said legs at a second cutter end of said bit body;

one or more drag bit legs attached to said body at said second cutter end coextending with said one or more cutter cone legs, said drag bit legs having a plurality of diamond stud body insert blanks inserted in stud retaining holes formed in a cutting face of said one or more drag bit legs, said face formed by said drag bit legs being substantially wedge-shaped, a cantilevered tip of said wedge-shaped face being positioned nearest the center of said second cutting end of said hybrid rock bit; and a single diamond studless disk is metallurgically bonded to a platform surface formed on the innermost cantilevered tip of said wedge-shaped face of said drag bit leg, said disk having a first cutting surface and a second mounting surface, said second surface being mounted to said platform surface of said face, said diamond disk serves to remove the core material from the center of a borehole bottom.

* * * * *